US007333065B2

(12) United States Patent
Lindackers et al.

(10) Patent No.: US 7,333,065 B2
(45) Date of Patent: Feb. 19, 2008

(54) MODULAR ANTENNA ASSEMBLY FOR AUTOMOTIVE VEHICLES

(75) Inventors: Ralf Lindackers, Waterford, MI (US); Hasan Yasin, Holly, MI (US); Andreas D. Fuchs, Lake Orion, MI (US); Ayman Duzdar, Holly, MI (US)

(73) Assignee: Receptec Holdings, LLC, Holly, MI (US)

( * ) Notice: Subject to any disclaimer, the term of this patent is extended or adjusted under 35 U.S.C. 154(b) by 95 days.

(21) Appl. No.: 11/271,372

(22) Filed: Nov. 10, 2005

(65) Prior Publication Data

US 2007/0103374 A1 May 10, 2007

(51) Int. Cl.
*H01Q 1/32* (2006.01)

(52) U.S. Cl. ..... 343/713; 343/872

(58) Field of Classification Search ..... 343/711, 343/712, 713, 872, 704
See application file for complete search history.

(56) References Cited

U.S. PATENT DOCUMENTS

| | | | | |
|---|---|---|---|---|
| 6,023,245 | A * | 2/2000 | Gomez et al. | 343/725 |
| D461,796 | S | 8/2002 | Boyer | |
| D465,480 | S | 11/2002 | Boyer | |
| 6,674,412 | B1 * | 1/2004 | Schmidt et al. | 343/872 |
| 6,762,727 | B2 * | 7/2004 | Rochford et al. | 343/713 |
| 6,879,294 | B2 * | 4/2005 | Yuanzhu | 343/725 |
| 2007/0085361 | A1 * | 4/2007 | Hauser | 296/1.08 |
| 2007/0171138 | A1 * | 7/2007 | Noro | 343/713 |

* cited by examiner

*Primary Examiner*—Tho Phan
(74) *Attorney, Agent, or Firm*—Harness, Dickey & Pierce, P.L.C.

(57) ABSTRACT

The specification discloses a modular antenna for automotive vehicles. The antenna includes a base assembly that can be used on a variety of vehicle platforms and a radome assembly that is specific to a particular vehicle platform. The radome assembly snap-fits onto the base assembly, and can be installed during or after vehicle assembly. A wide variety of radome assemblies of different shapes, styles, and colors can be used in conjunction with a single base assembly.

8 Claims, 8 Drawing Sheets

MODULAR ANTENNA ASSEMBLY FOR AUTOMOTIVE VEHICLES

BACKGROUND OF THE INVENTION

The present invention relates to antennas, and more specifically to antennas for automotive vehicles.

A wide variety of antennas have been developed for automotive vehicles. The antennas are adapted to receive signals in a variety of formats, including but not limited to AM radio, FM radio, satellite radio, global positioning system (GPS), cell phones, and citizens band (CB). Often the antennas are designed for a specific location on the vehicle. For example, antennas for receiving circularly polarized signals, such as those associated with satellite radio and GPS, are typically mounted on the vehicle roof.

An antenna designed for installation on a vehicle body panel, such as the vehicle roof, must address a variety of issues in addition to receiving signals. First, the antenna should be aesthetically pleasing—at least to the extent possible in view of its functionality. Second, the antenna should conform closely to the body panel on which it is mounted. To achieve these goals, the antenna is shaped to match the contour of the body panel on which it will be mounted. Consequently, each antenna must be uniquely designed for the vehicle platform. An antenna designed for one platform typically will not be acceptable for mounting on a different platform having a different shape. The need to have unique antennas for unique vehicles undesirably increases design complexity, manufacturing complexity, and inventory complexity.

SUMMARY OF THE INVENTION

The aforementioned problems are overcome in the present invention comprising a modular antenna assembly for automotive vehicles. The antenna assembly includes a base assembly that is suitable for installation on a wide variety of vehicle platforms and a radome assembly unique to a particular vehicle platform. The radome assembly can be easily yet securely attached to the base assembly during or subsequent to installation of the base assembly on the vehicle.

The present invention enables a common antenna platform (i.e. the base assembly) to be utilized across a wide variety of vehicle platforms, while only the radome assembly is unique to a vehicle platform.

These and other objects, advantages, and features of the invention will be more fully understood and appreciated by reference to the detailed description of the preferred embodiment and the drawings.

DESCRIPTION OF THE CURRENT EMBODIMENT

Figure 1:
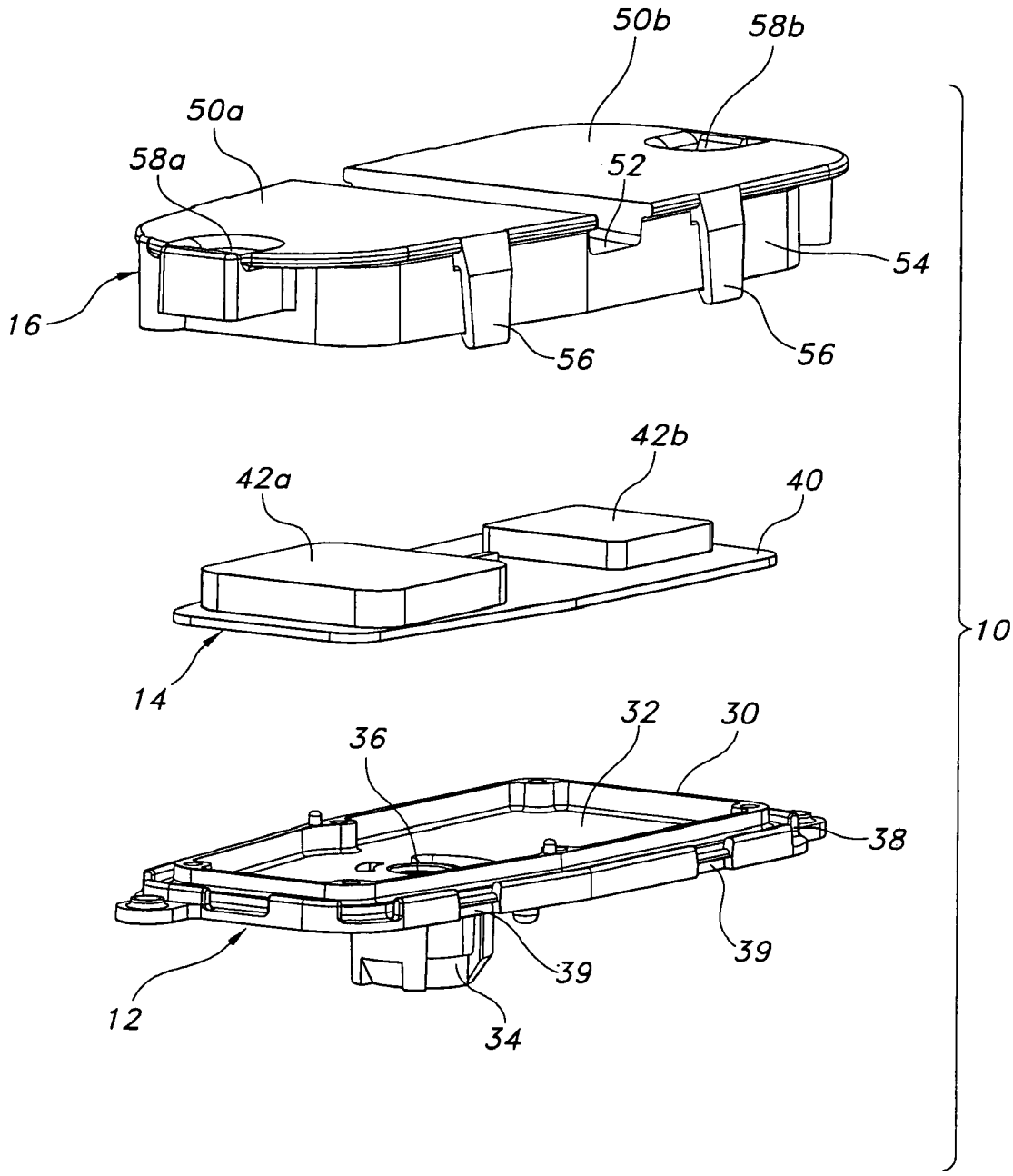
FIG. 1 is a perspective exploded view of the base assembly.

An antenna assembly constructed in accordance with a preferred embodiment of the invention is illustrated in the drawings. The antenna assembly includes a base assembly 10 (FIGS. 1 and 3) an a radome assembly 20 (FIGS. 2 and 4). When installed on a vehicle, the base assembly 10 is secured directed to the vehicle body panel, and the radome assembly 20 is snap-fitted onto the base assembly.

I. Base Assembly

Figure 2:
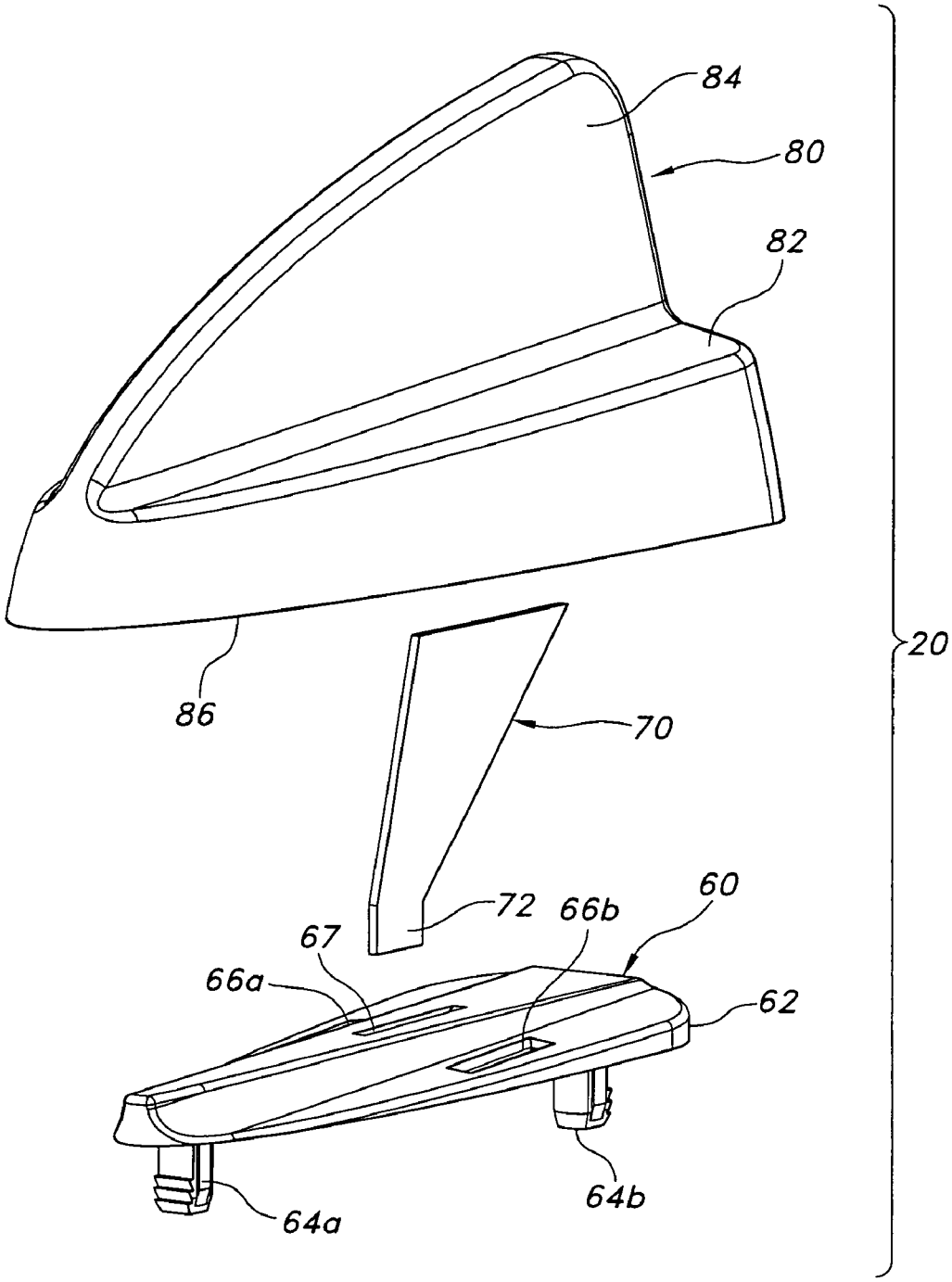
FIG. 2 is a perspective exploded view of the radome assembly.
Figure 3:
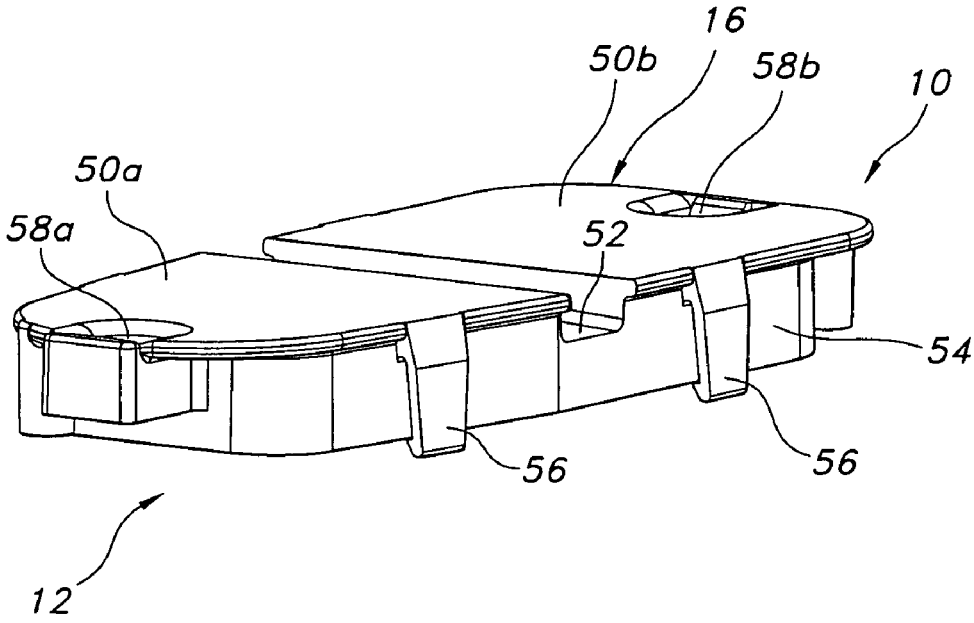
FIG. 3 is a perspective assembled view of the base assembly.
Figure 4:
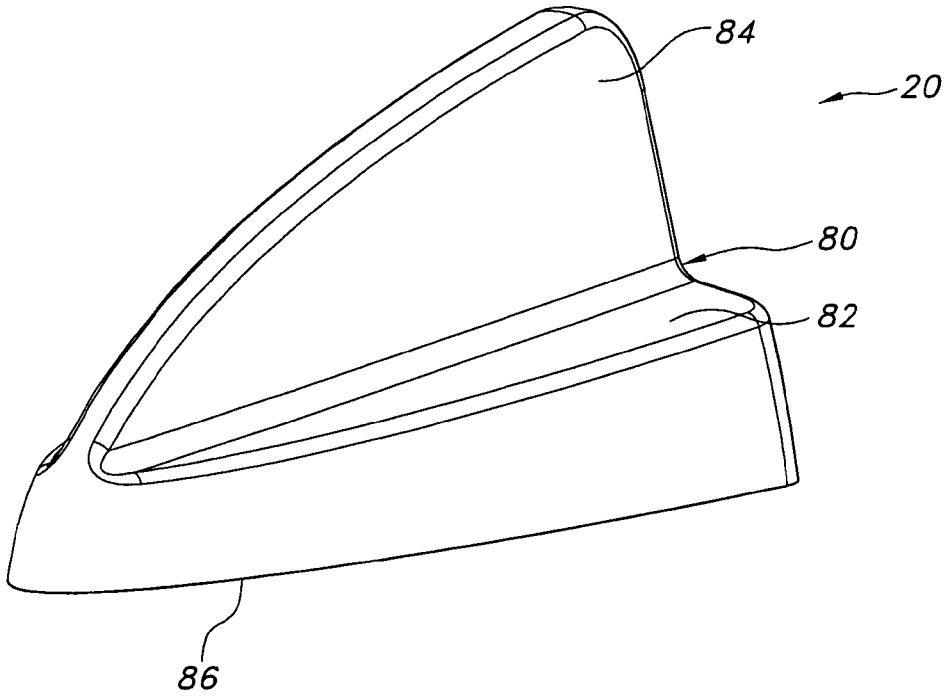
FIG. 4 is a perspective view of the assembled radome assembly.
Figure 5:
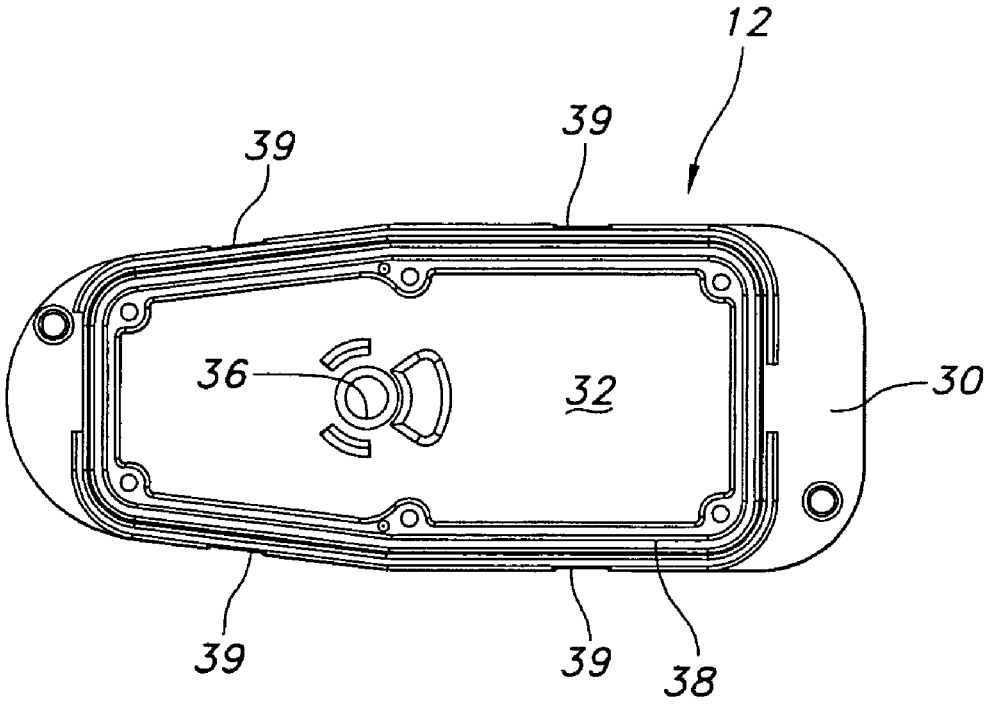
FIG. 5 is a top plan view of the chassis.
Figure 6:
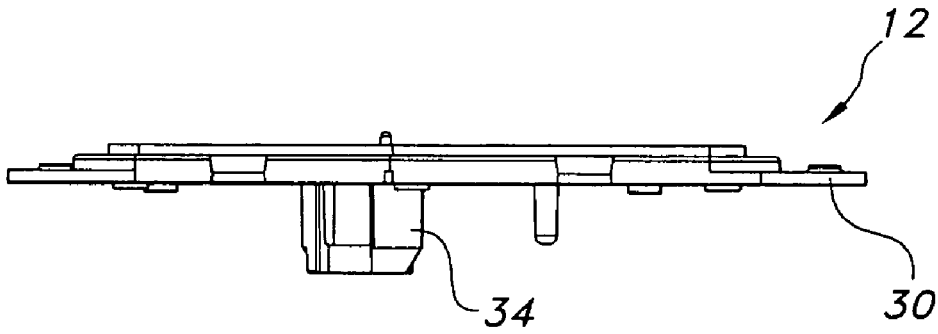
FIG. 6 is a side elevational view of the chassis.
Figure 7:
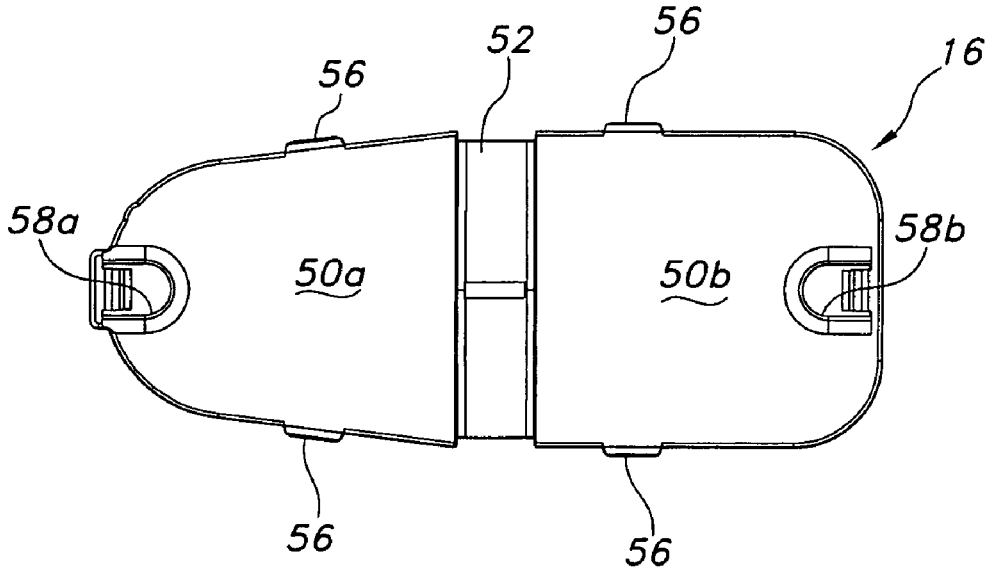
FIG. 7 is a top plan view of the base cover.
Figure 8:
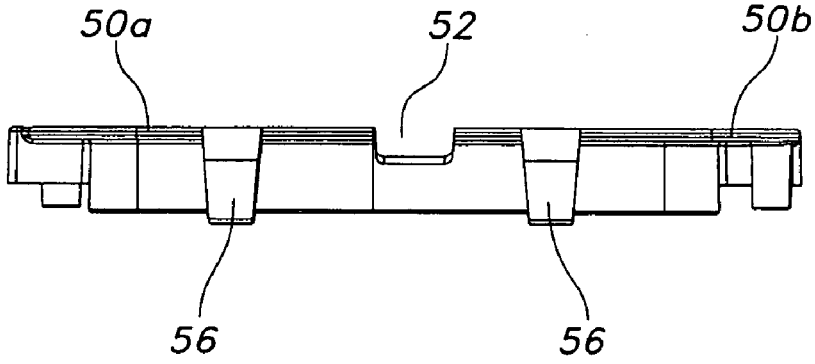
FIG. 8 is a side elevational view of the base cover.
Figure 9:
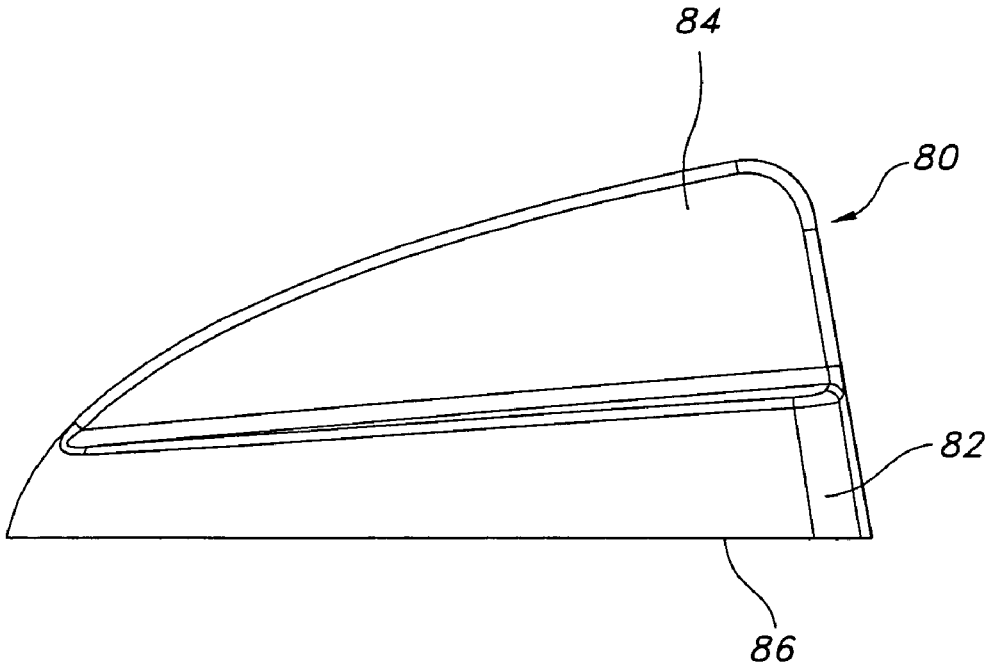
FIG. 9 is a side elevational view of the radome.
Figure 10:
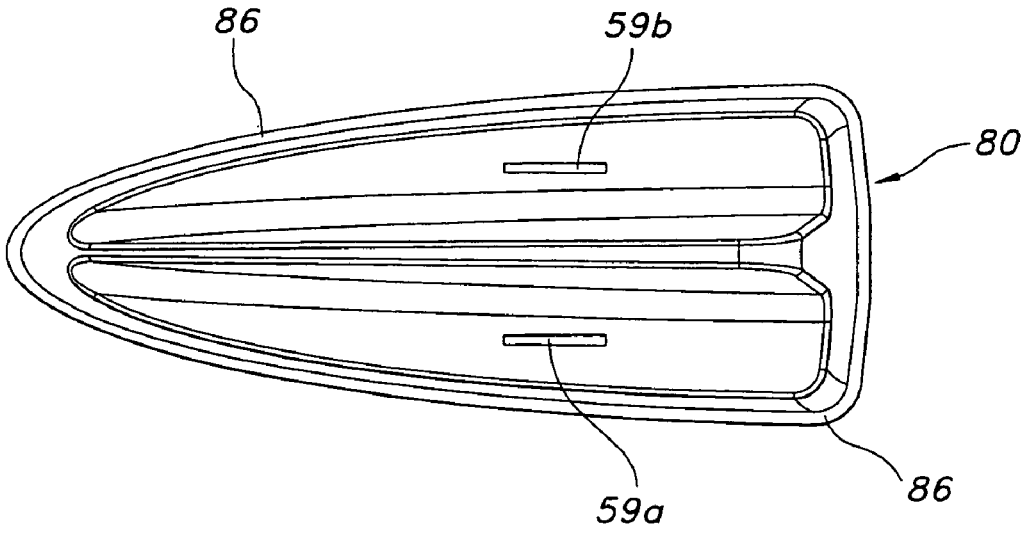
FIG. 10 is a bottom plan view of the radome.
Figure 11:
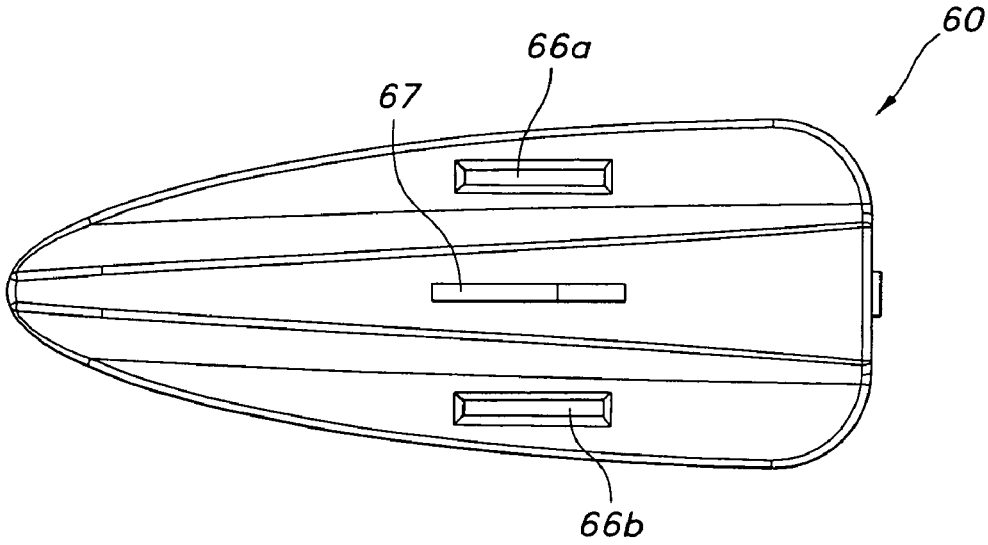
FIG. 11 is a top plan view of the connector piece.
Figure 12:
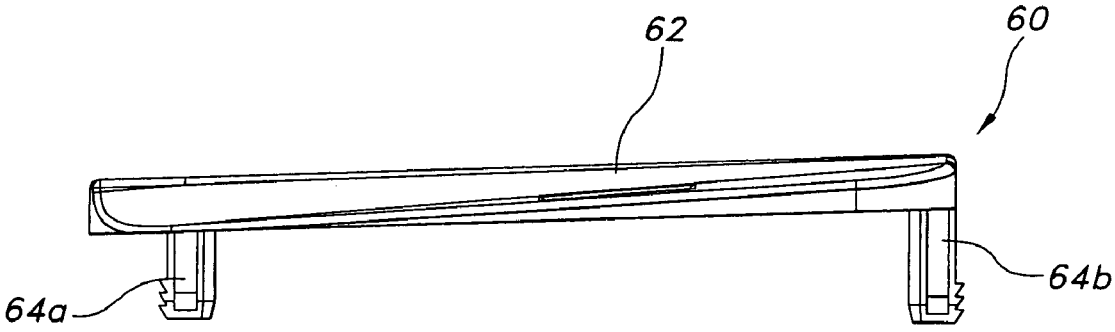
FIG. 12 is a side elevational view of the connector piece.

The base assembly 10 is illustrated in FIG. 1 (exploded) and FIG. 3 (assembled). The base assembly includes a chassis 12, a printed circuit (PC) board assembly 14, and a base cover 16.

The chassis 12 is die cast of zinc, although other manufacturing processes and materials may be used. The chassis includes a generally planar body 30 defining a pocket 32 in its upper surface. An attachment stud or lug 34 extends from the underside of the body 30 for attachment to a vehicle body panel in conventional fashion. The lug 34 defines a central aperture 36 extending through the body and the lug for receiving electrical wires and/or leads. A groove 38 extends around the upper surface of the body 30 for receiving the base cover 16. The chassis 12 also defines a plurality of recesses or receivers 39 for receiving the catches 56 on the base cover 16.

The PC board assembly 14 includes a printed circuit (PC) board 40 and a pair of ceramic antenna elements 42*a* and 42*b* mounted thereon. In the current embodiment, each antenna elements is ceramic-based; and the two antenna elements are designed for the reception of satellite radio signals and GPS signals. Other suitable antenna elements may be used and will be readily known to those skilled in the art. The PC board 40 is dimensioned to be received within the pocket 32 on the chassis 12. Electrical wires and/or leads (not shown) extend from the printed circuit board 40 through the hole 36 in the chassis 12.

The base cover 16 is fabricated of plastic as a single piece. Other suitable materials and manufacturing processes will be know to those skilled in the art. The base cover 16 includes a generally planar body 50 having two portions 50*a* and 50*b* defining a groove 52 therebetween for receiving the radome assembly antenna element 70. A perimeter skirt or flange 54 extends downwardly from the body 50 and is received within the groove 38. A plurality of spring-loaded catches 56 extend downwardly from the body 50 to snap-fit onto the chassis 12 and specifically within the receivers 39. The body 50 defines a pair of receivers or sockets 58*a* and 58*b*. The sockets receive snap fingers on the radome assembly as will be described.

FIG. 3 illustrates the base assembly 10 assembled. The PC board 14 (not visible in FIG. 3) is nested within the pocket 32 (also not visible in FIG. 3) of the chassis 12. The skirt 54 of the base cover 16 fits within the groove 38. A conventional seal such as rubber gasket or a sealant may be included within the groove 38 to improve the seal between the base cover 16 and the chassis 12. The catches 56 snap-fit around the chassis 12. When so assembled, the parts are securely interconnected and retained together, and the PC board 14 is sealed within the assembly.

II. Radome Assembly

The radome assembly 20 is illustrated in FIG. 2 (exploded) and FIG. 4 (assembled). The radome assembly includes a radome 80, a connector piece 60, and an antenna element 70.

The radome 80 is configured to house one or more antenna elements 70, to be aesthetically pleasing, and to be aerodynamic. The radome 80 includes a body portion 82 and a center fin 84 extending upwardly therefrom. A pair of locator elements 59*a* and 59*b* extend downwardly from the interior of the center fin 84. The body portion 82 terminates in a lower peripheral edge 86 which extends around the entire perimeter of the radome. The lower edge 86 is configured to closely conform to the particular automotive vehicle body panel on which the antenna assembly will be mounted. The close contour design achieves a "zero gap" appearance between the antenna and the vehicle.

The antenna element 70 is secured within the radome 80 using techniques well-known to those skilled in the art. The lower portion 72 of the antenna element 70 extends into the groove 52 in the base assembly 10 for effective coupling to the PC board assembly 14. The coupling in the current embodiment is inductive or galvanic, and other coupling techniques (such as conductive silicone) will be known to those skilled in the art. The element 70 in the current embodiment is designed for cellular phone signals, but the element could be designed for other signals. It is envisioned that more than one element could be included in the radome. It also is envisioned that no element could be included in the radome, in which case the center fin 84 could be omitted.

The connector piece 60 provides a means of connecting the radome assembly to the base assembly. The connector piece includes a body 62 defining a pair of slots 66*a* and 66*b* for receiving the connector elements 59*a* and 59*b* respectively on the radome 50. The body also defines a slot 67 through which the lower portion 72 of the antenna element 70 extends. A pair of barbed connectors 64*a* and 64*b* extend downwardly from the body 62 to be received in the receivers 58*a* and 58*b*.

In the assembled radome assembly 20 (FIG. 4), the connector piece 60 is closely received within the body portion 82 of the radome 80 with the antenna 70 secured therebetween. The locator elements 59*a* and 59*b* from the radome 80 extend through the slots 66 to assist in locating the radome and the connector piece 60. The two parts are solvent welded together. Alternatively, adhesive or other suitable means may be used to intersecure the two components.

III. Installation

The base assembly 10 is not specific to a vehicle platform and indeed can be used across a wide variety of vehicle platforms having a wide variety of body panel configurations. The base assembly 10 is delivered to the vehicle manufacturer for installation on a vehicle during vehicle assembly in conventional fashion—typically to the vehicle roof.

The radome assembly 20 also is delivered to the vehicle manufacturer. However, the radome assembly 20 typically is not installed on the vehicle during vehicle assembly. Because of the height restrictions related to vehicle shipping, the radome assembly 20 is shipped uninstalled with the vehicle, for example in the glove box of the vehicle. After the vehicle is received by the dealer, the radome assembly 20 is removed from the glove box and installed on the base assembly 10 simply by aligning the fingers 64 with the receivers 58 and pushing the radome assembly onto the base assembly. When installed, the lower edge 86 of the radome 80 lies against and conforms to the vehicle body panel. The radome 80 can be color matched to the vehicle.

The present invention enables a common base assembly 10 to be used across a wide variety of vehicle platforms. Only the radome assembly 20 is customized to a vehicle platform to fit closely against the body panel to achieve a zero gap appearance. Economies of scale can be realized in both design and manufacturing because the base assembly 10 need not be redesigned for different vehicle platforms. Consequently, the present invention reduces manufacturing and inventory costs. Further, a plurality of radomes of virtually unlimited styles and colors can be used in conjunction with a single base assembly.

The above description is that of a current embodiment of the invention. Various alterations and changes can be made without departing from the spirit and broader aspects of the invention as defined in the appended claims, which are to be interpreted in accordance with the principles of patent law including the doctrine of equivalents.

The invention claimed is:

1. An antenna for installation to a vehicle body wall, the antenna comprising:

a base assembly mountable to the vehicle body wall, the base assembly including a chassis, a base cover coupled to the chassis, at least one antenna element disposed within an interior collectively defined by the chassis and the base cover, and at least one socket defined by the base cover;

a radome assembly snap-fittable onto the base assembly, the radome assembly including a radome having a lower peripheral edge, at least one antenna element within the radome, and a connector piece attached to the radome, the connector piece having at least one connector extending downwardly therefrom to be received within the at least one socket of the base cover to thereby allow the radome assembly to snap-fit onto the base assembly;

whereby, in the final installed position of the antenna to the vehicle body wall, the lower peripheral edge of the radome closely conforms to the vehicle body wall to thereby achieve a zero gap appearance.

2. The antenna as defined in claim 1 wherein the at least one connector of the connector piece comprises at least one barbed snap finger extending downwardly from the body of the connector piece to be snap fit into the at least one socket of the base cover.

3. The antenna as defined in claim 1 wherein:

the base cover includes a forward portion defining at least one or more sockets and a rearward portion defining at least one or more sockets; and the connector piece includes a forward portion from which at least one or more connectors downwardly extend and a rearward portion from which at least one or more connectors downwardly extend.

4. The antenna as defined in claim 1 wherein the at least one antenna element disposed within the interior collectively defined by the chassis and the base cover comprises two or more antenna elements mounted on a board of a printed circuit board assembly respectively configured for reception of satellite radio signals and global positioning system (GPS) signals, and wherein the at least one antenna element within the radome comprises an antenna configured for reception of terrestrial signals.

5. The antenna as defined in claim 1, further comprising electrically-conductive silicone disposed generally between an end portion of the at least one antenna element within the radome and a portion of the base assembly.

6. The antenna as defined in claim 1 wherein the base assembly is configured for use as a common base assembly with different radome assemblies that are uniquely customized for different vehicle platforms to fit closely against the vehicle body wall to thereby achieve a zero gap appearance therewith.

7. The antenna as defined in claim 1 wherein:

the base cover includes a generally planar body having portions defining a groove therebetween for receiving a lower end portion of the at least one antenna element within the radome, a perimeter skirt extending generally downwardly from the body of the base cover, and at least one spring-loaded catch extending generally downwardly from the body; and the chassis includes a generally planar body, a groove extending generally around an upper surface of the body of the chassis for receiving a lower edge of the perimeter skirt of the base cover, and at least one receiver for receiving the at least one catch of the base cover to thereby allow the base cover to snap-fit onto the chassis.

8. The antenna as defined in claim 1 wherein:

the radome includes a body portion terminating in the lower peripheral edge, a fin extending upwardly from the body portion, and at least one locator element extending downwardly relative to the fin; and the connector piece includes a body defining at least one slot for receiving the at least one locator element of the radome to thereby assist in locating the radome and the connector piece, the connector piece body also defining at least one slot through a lower portion of the at least one antenna element within the radome.

* * * * *